US010443809B2

(12) United States Patent
Riethmüller et al.

(10) Patent No.: US 10,443,809 B2
(45) Date of Patent: Oct. 15, 2019

(54) ARRANGEMENT FOR GENERATING LIGHT EFFECTS HAVING A SHADOWING FUNCTION

(71) Applicant: Deutsche Institute für Textil—und Faserforschung Denkendorf, Denkendorf (DE)

(72) Inventors: Christoph Riethmüller, Leonberg (DE); Bastian Baesch, Stuttgart (DE); Holger Illg, Wendlingen (DE)

(73) Assignee: Deutsche Institute für Textil—und Faserforschung Denkendorf, Denkendorf (DE)

( * ) Notice: Subject to any disclaimer, the term of this patent is extended or adjusted under 35 U.S.C. 154(b) by 253 days.

(21) Appl. No.: 15/310,619

(22) PCT Filed: Apr. 7, 2015

(86) PCT No.: PCT/EP2015/057460
§ 371 (c)(1),
(2) Date: Nov. 11, 2016

(87) PCT Pub. No.: WO2015/172941
PCT Pub. Date: Nov. 19, 2015

(65) Prior Publication Data

US 2017/0082259 A1 Mar. 23, 2017

(30) Foreign Application Priority Data

May 12, 2014 (DE) ..... 10 2014 106 602

(51) Int. Cl.
*F21V 1/12* (2006.01)
*F21V 11/14* (2006.01)
(Continued)

(52) U.S. Cl.
CPC ..... *F21V 1/12* (2013.01); *F21V 11/14* (2013.01); *F21V 11/186* (2013.01); *F21W 2121/00* (2013.01)

(58) Field of Classification Search
CPC ..... F21V 1/12; F21V 1/14; F21V 11/14
See application file for complete search history.

(56) References Cited

U.S. PATENT DOCUMENTS

| | | | | |
|---|---|---|---|---|
| 3,961,434 A * | 6/1976 | Sampon | G09F 13/34 40/437 |
| 2010/0226117 A1* | 9/2010 | Krans | G09F 13/00 362/97.1 |
| 2012/0218752 A1* | 8/2012 | Sumitani | F21V 11/14 362/235 |

FOREIGN PATENT DOCUMENTS

| | | |
|---|---|---|
| DE | 203 00 615 U1 | 3/2003 |
| DE | 10 2012 215 165 A1 | 2/2014 |

* cited by examiner

*Primary Examiner* — Anh T Mai
*Assistant Examiner* — Nathaniel J Lee
(74) *Attorney, Agent, or Firm* — Leydig, Voit & Mayer, Ltd.

(57) ABSTRACT

An arrangement (10) for generating a light effect (26) includes an obscuration sheet material (11) and a divergence sheet material (12) arranged in spaced apart relation to a rear side (23) of an effect sheet material (13). The obscuration sheet material (11) has at least one transmission region (17) and at least one shielding region (18). On the light entry side (15), which faces away from the effect sheet material (13), light (L) impinges on the obscuration sheet material (11) and is severely reduced or completely shielded in shielding region (18), while light (L) passes through the at least one transmission region (17). By means of the divergence sheet material (12), divergent light rays (LD) are produced at the corresponding transmission region (17), which divergent light rays impinge on the rear side (23) of the effect sheet
(Continued)

material (13) and generate a light effect (26) for a viewer (25) looking at the viewing side (24).

13 Claims, 4 Drawing Sheets

(51) Int. Cl.
*F21V 11/18* (2006.01)
*F21W 121/00* (2006.01)

ARRANGEMENT FOR GENERATING LIGHT EFFECTS HAVING A SHADOWING FUNCTION

FIELD OF THE INVENTION

The invention relates to arrangements for generating light effects.

BACKGROUND OF THE INVENTION

Arrangements for generating light effects have been known, for example, from publication WO 2011/015621 A1. The known arrangement comprises a light source and a textile sheet material arranged remote from the light source. This textile sheet material is configured as a woven fabric and comprises a warp thread layer as well as a weft thread layer. The light emitted by the light source may be reflected or deflected by the warp threads or weft threads. On the viewing side of the woven fabric facing away from the light source, there is thus created a light pattern that can generate a three-dimensional light effect for the viewer.

Such arrangements may be illuminated, for example, with the aid of light-emitting diodes or other light sources and may be used for decorative purposes.

OBJECTS AND SUMMARY OF THE INVENTION

It is an object of the present invention to provide an arrangement for generating light effects that has increased functionality.

According to the invention the arrangement comprises several sheet materials arranged in partially overlapping relation in the viewing direction of a viewer. The viewing direction is essentially at a right angle with respect to the plane of extent of the sheet material.

The arrangement comprises an obscuration sheet material. The obscuration sheet material has a light entry side and a light exit side. The light entry side faces an artificial or natural light source. The obscuration sheet material has at least one transmission region and at least one shielding region. The light impinging on the obscuration sheet material on the light entry side moves at least through the at least one transmission region and exits from the transmission region on the light exit side. The at least one shielding region is able to almost completely shield the light. In the shielding region, the obscuration sheet material may comply with the requirements of a so-called "blackout material". At least the intensity of the light exiting on the light exit side is greater in the transmission region than in the shielding region so that a sufficient intensity difference of the light between the darker shielding region and the lighter transmission region is ensured on the light exit side. In a preferred exemplary embodiment, the obscuration sheet material is provided by a blackout sheet material, wherein the at least one transmission region is formed by apertures at least in the minimum of one obscuration layer of the obscuration sheet material.

The at least one transmission region may have any shape or form. In this manner it is possible for one or more transmission regions to form a logo, lettering, a pattern or the like. It may also be used for esthetic room design. Preferably, the entire surface of the one transmission region or the several transmission regions is smaller by at least the factor of 10 than the entire remaining surface of the at least one shielding region.

Furthermore, the arrangement comprises an effect sheet material for generating a light pattern. In so doing, in particular a three-dimensional light effect can be generated on a viewing side of the effect sheet material. The effect sheet material is made of a textile material, preferably a woven fabric. Due to the arrangement of the yarns or threads in the textile material, it is possible to produce the desired light effect. The effect sheet material has a rear side facing the obscuration sheet material and a viewing side opposite the rear side. The light exiting from the transmission regions of the obscuration sheet material impinges on the rear side of the effect sheet material and is reflected and/or scattered and/or refracted and/or diffracted by the threads or yarns. As a result of this, the light pattern or the light effect is produced on the viewing side in the viewing direction.

Due to the configuration of the arrangement according to the invention, it is possible to arrange—on the light impingement side of the obscuration sheet material—light sources other than punctiform or hemispheric ones. The obscuration sheet material tends to act as a diaphragm. Consequently, it is possible also to generate more complex light patterns or lettering with light effects. Finally, it also is possible to use natural light, in particular sun light, as a light source via the obscuration sheet material. In this case, it is preferred if the arrangement comprises, in addition to the obscuration sheet material and the effect sheet material, a divergence sheet material in order to convert the parallel sun light into divergent light. Consequently, it is possible, via the divergence sheet material, to generate, at least in the one transmission region, light that is hemispherically emitted and preferably approaches isotropic light. The divergence sheet material and the obscuration sheet material generate, so to speak, in the at least one transmission region, one or more virtual punctiform light sources. Considering this preferred embodiment, the arrangement also is suitable as a sun screen or for shading purposes and can thus be used in sun shades, sun umbrellas, darkening shades or similar such devices.

Preferably, the intensity of the light passing through the at least one transmission region is at least greater by 5 to 10 times, preferably by 10 to 30 times, than the intensity of the light passing through the at least one shielding region.

In a preferred embodiment, the divergence sheet material is arranged between the obscuration sheet material and the effect sheet material. As an alternative thereto, the divergence sheet material may also be a component of the obscuration sheet material.

Advantageously, the divergence sheet material and the obscuration sheet material are in planar contact with each other and are, for example, connected to each other in a material-bonded manner. For the generation of light effects, it is advantageous if the material of the divergence sheet material generating the divergent light is arranged very closely next to the at least one transmission region. Furthermore, handling of the arrangement is simplified if the divergence sheet material and the obscuration sheet material are firmly bonded to each other.

The divergence sheet material may comprise a foil and/or fiber material and/or textile material. For example, a fiber or fleece material displaying sufficient space between the fibers can be used for scattering the substantially parallel light.

The obscuration sheet material and/or the divergence sheet material and/or the effect sheet material may each consist of one or several layers in contact with each other. Consequently, it is possible, for example, to design the obscuration sheet material in such a manner that essentially no light can pass through the shielding regions. A multi-layer effect sheet material may be advantageous for achieving the desired light effects or light patterns.

In a preferred exemplary embodiment, the obscuration sheet material comprises a support layer that, for example, may consist of a foil material and/or of a fiber material and/or of a textile material. At least one obscuration layer is arranged on this support layer. In particular, it is possible for one or several obscuration layers to be arranged on both sides of the support layer.

The at least one transmission region can be formed by an aperture in the obscuration sheet material, said aperture being provided in all the layers of the obscuration sheet material. As an alternative thereto, it is also possible that the support layer is maintained in the transmission region and only the obscuration layers arranged thereon are open. In so doing, the support layer may act as the divergence layer and thus produce the divergent light. Consequently, the support layer may be a component of the divergence sheet material or form the divergence sheet material.

In a preferred embodiment, the obscuration sheet material and/or the effect sheet material can be wound onto a winding shaft or unwound therefrom. As an alternative thereto, the obscuration sheet material and/or the effect sheet material may form a pleated shade and be compressed or pulled apart in an accordion-like manner. In conjunction with this, as mentioned hereinabove, it is possible for the divergence sheet material to be firmly bonded to the obscuration sheet material in a planar manner.

The space between the obscuration sheet material and the effect sheet material or between the obscuration sheet material and the divergence sheet material may be formed by an air gap and/or a connecting layer. At least in the region in which the light spreads from the at least one transmission region or the divergence sheet material up to the rear side of the effect sheet material, the connecting layer consists of material that is transparent to the light wave length that is used or the light wave length range that is used.

In order to avoid the incidence of interfering light, the connecting layer may be configured so as to be opaque—at least in one or more edge regions—to the extent feasible. The connecting layer may connect the effect sheet material to the divergence sheet material or to the obscuration sheet material, also only locally to specify the space.

The obscuration sheet material and the effect sheet material may have, together, one pull rod that is guided in a sliding manner in a guiding device. This embodiment may be used, for example, when the obscuration sheet material and/or the effect sheet material are configured as a roller shade or as a pleated.

In one exemplary embodiment, the obscuration sheet material comprises two obscuration layers that can be shifted relative to each other, wherein each has at least one transmission region and at least one shielding region. Preferably, the transmission regions and the shielding regions are designed or contoured identically. Due to the relative shifting of the two obscuration layers, it is thus possible to achieve a complete blackout when the transmission region of the one obscuration layer is in register with the shielding region of the respectively other obscuration layer. Conversely, a maximum light passage through the transmission region can be achieved if the two transmission regions of the two obscuration layers are in complete register. Due to this configuration, the size and/or form of the overlap region available for the light passage can be adjusted between the two transmission regions of the two obscuration layers, in particular in a continuous manner.

Other objects and advantages of the invention will become apparent upon reading the following detailed description and upon reference to the drawings.

Figure 1:
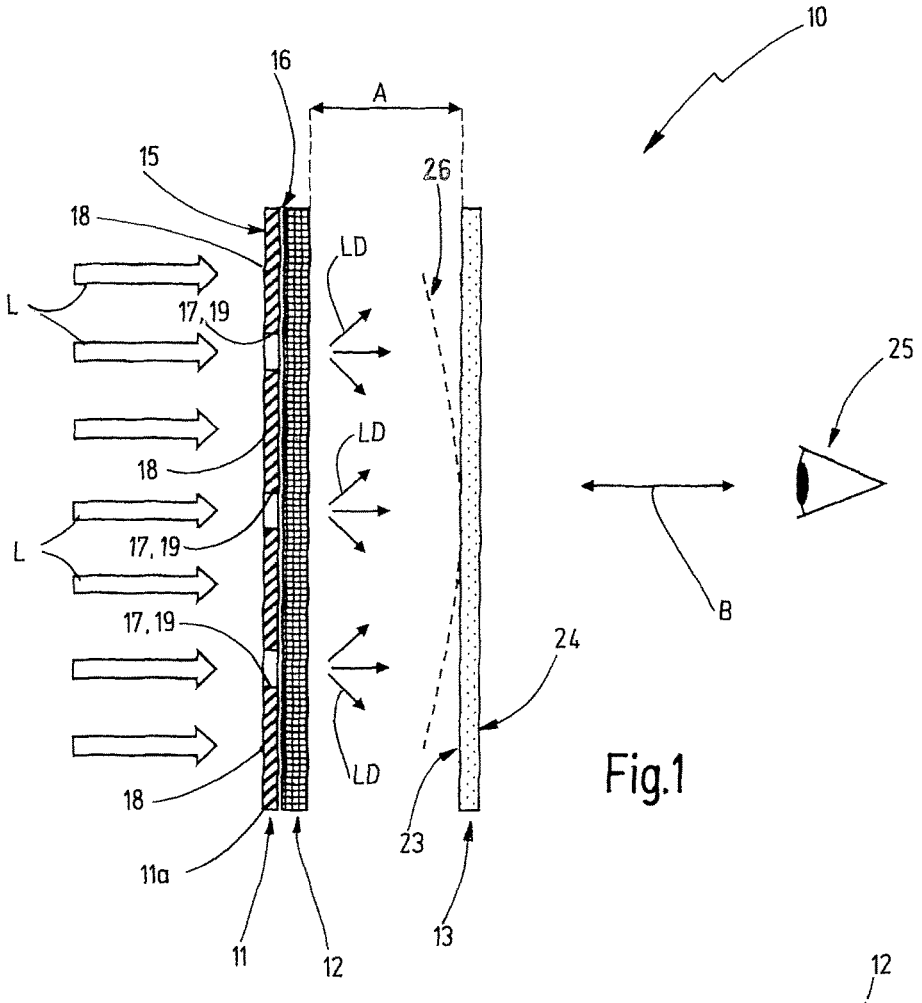
FIG. 1 is a schematic cross-sectional view of an illustrative light effect generating arrangement in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Figure 2:
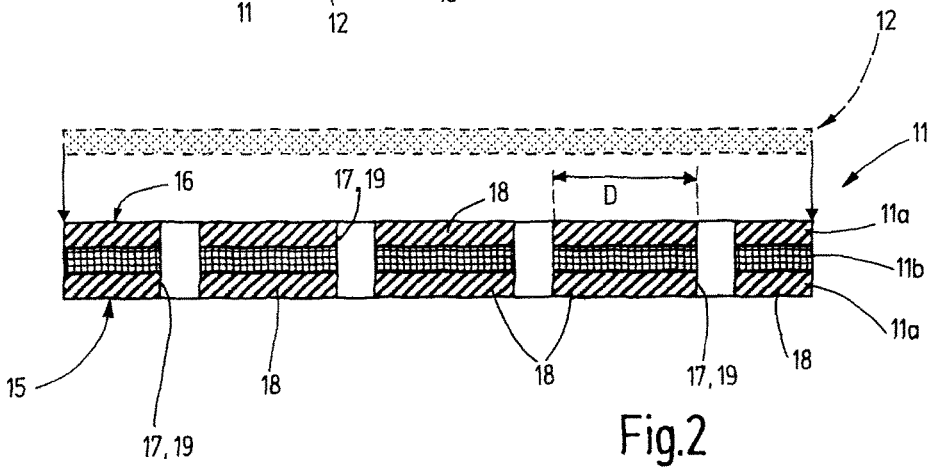
FIG. 2 is a schematic cross-sectional view of an exemplary embodiment of light effect generating arrangement comprising an obscuration sheet material and a divergence sheet material.

Referring now more particularly to FIGS. 1 and 2 of the drawings, there is shown an illustrative multilayer arrangement 10 for generating light effects in accordance with the invention. The arrangement 10 comprises an obscuration sheet material 11, a divergence sheet material 12 and an effect sheet material 13. The obscuration sheet material 11 has a light entry side 15 and an opposite light exit side 16. The obscuration sheet material 11 has at least one transmission region 17 and at least one shielding region 18. The light L that is emitted by an artificial or natural light source and impinges on the light entry side 15 of the obscuration sheet material 11 moves at minimum through the at least one transmission region 17 through the obscuration sheet material 11 and exits on the light exit side 16. In so doing, the obscuration sheet material 11 is configured in such a manner that the intensity reduction of the light impinging on the light entry side 15 is clearly greater in the at least one shielding region 18 and, for example, is at least ten times greater than the intensity reduction of the light passing through the at least one transmission region 17.

In the illustrated, preferred, exemplary embodiment of arrangement 10, the impinging light L is almost completely shielded in the at least one shielding region 18, so that—due to the shielding region 18—only a negligible portion of light may penetrate. The obscuration sheet material 11 in the at least one shielding region 18 is preferably constructed in such a manner that it complies with the requirements for a so-called "blackout" material. The at least one transmission region 17 is formed by at least one aperture 19 in the obscuration sheet material 11, so that the light L may move without impairment from the light entry side 15 through to the light exit side 16.

Considering the illustrated exemplary embodiments, several apertures 19 in the form of cylindrical holes are provided in the obscuration sheet material 11. The form or contour of the apertures may also be selected deviating from a circular cross-section. The total cross-sectional area of the apertures 19 is smaller and, preferably, smaller by at least the factor of 10 than the total area of the shielding region 18 surrounding the apertures 19. Furthermore, in accordance with the example, the distance D between two directly adjacent apertures 19 in one spatial direction in which the obscuration sheet material 11 extends is greater and, preferably, at least twice as large as the dimension of the aperture 19 in this spatial direction.

Figure 3:
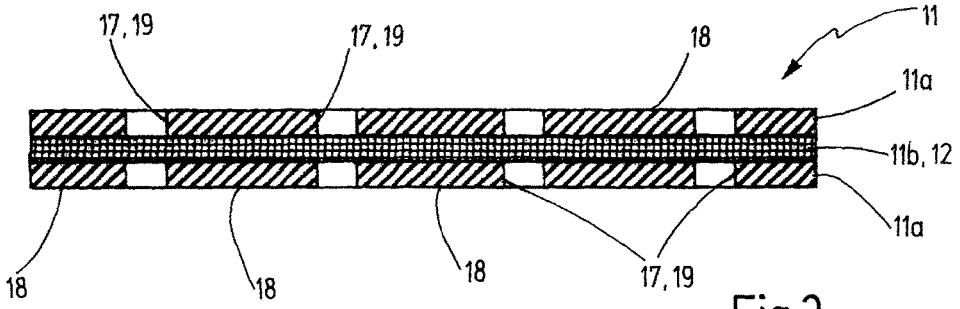
FIG. 3 is a schematic cross-sectional illustration of the illustrated obscuration sheet material.

In the exemplary embodiment of the obscuration sheet material 11 depicted FIG. 1, there is only one single obscuration layer 11*a*. Different therefrom in the exemplary embodiments of the obscuration sheet material 11 as depicted in FIGS. 2 and 3 there are several obscuration layers 11*a*. In the depicted exemplary embodiments the obscuration sheet material 11 comprises a support layer 11*b*. At least one obscuration layer 11*a* is applied to this support layer 11*b* to one side and, consistent with the example, to both sides.

The support layer 11*b* is provided for the production of the obscuration sheet material 11. Preferably, the support layer may be a textile material, for example, a woven fabric or also a knit fabric. Subsequently, one or more obscuration layers 11*a* are applied to the support layer 11*b*—on one or both sides. Preferably, the obscuration layers 11*a* consist of a plastic material. The number and thickness of the obscuration layers are selected such that the desired shielding effect required in the shielding region 18 for the impinging light L is achieved.

In order to produce the apertures 19, openings may subsequently be provided, and as schematically illustrated in FIG. 2, the openings extend completely through all the layers 11*a*, 11*b*. This may be accomplished by cutting, for example laser cutting, punching or other suitable separation process.

As an alternative thereto, it is also possible to mask the at least one transmission region 17 by the support layer 11*b* applied obscuration layer 11*a* (FIG. 3). In so doing, the apertures 19 are present only in the obscuration layers 11*a* and do not extend through the support layer 11*b*. As depicted in FIG. 3, the apertures 19 in the obscuration layers 11*b* are at least substantially in alignment in the viewing direction B. The viewing direction B is oriented at a right angle with respect to the plane of extent in which the obscuration sheet material 11 extends. In this embodiment, the support layer 11*b* may form or be a component of the divergence sheet material 12. The function of the divergence sheet material 12 will be explained hereinafter.

The divergence sheet material 12 is disposed to scatter parallel light L and to generate, in the region of the light exit side 16, divergent light rays LD in the at least one transmission region 17. If the transmission regions 17 or apertures 19 have a sufficiently small cross-section, a virtual punctiform light source is generated on the light exit side 16 at each aperture 19 in combination with the divergence sheet material 12, said punctiform light source emitting the divergent light rays LD in a hemispheric manner and, preferably, in an isotropic manner—to the extent that this is technically possible.

The divergence sheet material 12 may be a foil and/or a textile material and/or a fiber material and may be embodied as a woven fabric, knit fabric, fleece material or cellulose material. Preferably, the divergence sheet material 12 is connected to the obscuration sheet material 11 in a planar and firm manner. For example, it may be arranged directly on the light exit side 16 of the obscuration sheet material 11 (FIG. 1) or, alternatively, be integrated as a layer in the obscuration sheet material 11. As shown by FIG. 3, the divergence sheet material 12 may also be represented, for example, by the support layer 11*b* and be coated on one or both sides with an obscuration layer 11*a*.

The obscuration sheet material 11 thus has the function of a type of diaphragm and generates, in the at least one transmission region 17—together with the divergence sheet material 12—the divergent light rays LD. The divergent light rays LD impinge on the effect sheet material 13 that is arranged at the distance A from the divergence sheet material 12. The effect sheet material 13 has a rear side 23 that faces the divergence sheet material 12 or the light exit side 16 of the obscuration sheet material 11. The divergent light rays LD impinge on this rear side 23. Opposite the rear side 23, the effect sheet material 13 has a viewing side 24 which faces a viewer 25.

The effect sheet material 13 preferably comprises a textile material and/or a fiber material and/or a foil material. For example, the effect sheet material 13 may be made of one or more yarns—as a fabric in the exemplary embodiment. The divergent light rays LD impinge on the rear side 23 and are at least partially scattered and/or reflected and/or refracted by the effect sheet material and, in accordance with the example, in the respective yarn section. Due to the yarn makeup and/or the arrangement of the layers relative to each other, it is possible to generate a specified, desired light effect for the viewer 25. In particular, a three-dimensional light effect 26 may be created. Depending on the structure of the effect sheet woven material 13, there are a number of possibilities. For example, star-shaped rays may be generated around the virtual light sources at the apertures 19, with the rays extending, for the viewer 25, also out of the plane of the effect sheet material 13 toward the back into the room. It is also possible to generate elliptical or line patterns.

This three-dimensional effect is produced only when the light impinging on the rear side 23 is divergent. The arrangement 10 according to the invention may work with any desired natural or artificial light sources. For example, sun light impinging on the Earth is parallel, so that the effect sheet material 13 alone could not generate a light effect. The arrangement 10, however, produces the divergent light rays LD from the parallel light L and can thus produce a light effect 26 even in sun light. Therefore, the arrangement 10 is suitable for use in sun protection arrangements or shadowing arrangements such as, for example, sun umbrellas, sun sails, roller shades or the like. For example, when darkening a room during the day, it is still possible to produce a special light effect on the darkened windows.

In modification of the exemplary embodiments illustrated here, it is also possible to not cover a part of the transmission region 17 or one or more transition regions 17 with the divergence sheet material 12. This further can be accomplished with an aperture 19 also provided in the divergence sheet material 12. The light will then impinge through these apertures parallel on the effect sheet material 13. This can be used, for example, to create a sharp image of lettering or company logos.

If the arrangement 10 is operated with a light source that generates divergent light instead of parallel light L, the divergence sheet material 12 also may be omitted.

Figure 4:
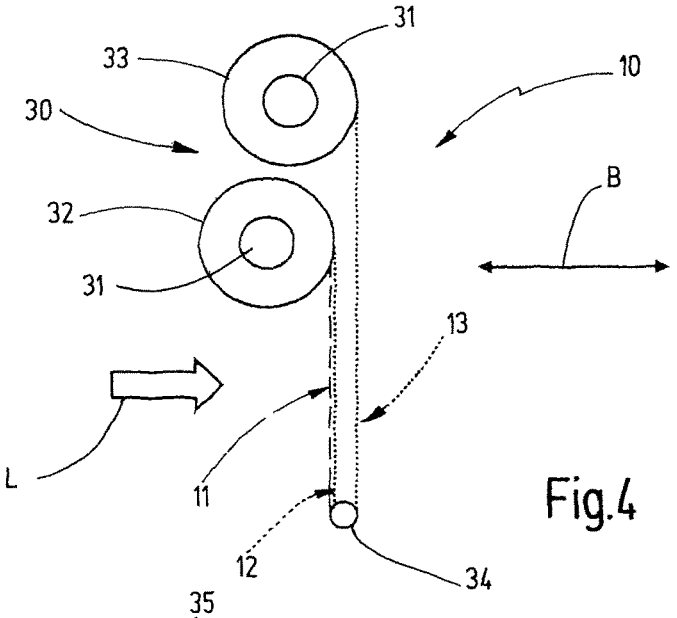
FIG. 4 is a schematic of an exemplary embodiment of a light effect generating arrangement configured as a double roller shade.
Figure 5:
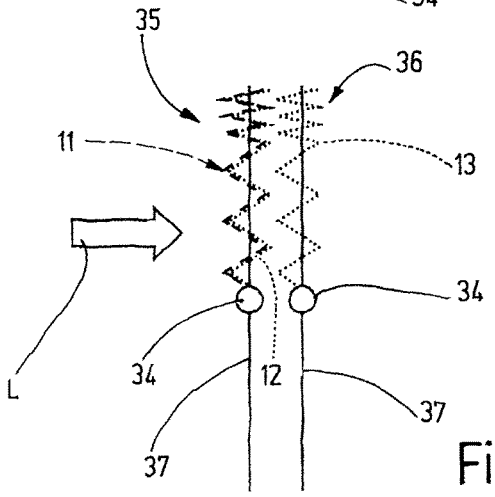
FIG. 5 is a schematic of an exemplary embodiment of an arrangement configured as a pleated shade.

FIGS. 4 and 5 show, schematically, two further exemplary embodiments of the arrangement 10. In the exemplary embodiment according to FIG. 4, the arrangement 10 is configured in the form of a double roller shade 30. The obscuration sheet material 11 and the divergence sheet material 12 are wound in direct, intimate contact on a common winding shaft 31 of a first roller shade 32. The effect sheet material 13 is wound onto the winding shaft 21 of a second roller shade 33. The two roller shades 32, 33 can be coupled with each other, so that, when a winding shaft 31 of the one roller shade 32 or 33 is being rotated, the winding shaft 31 of the other roller shade 33 and 32, respectively, will also rotate. For example, this can be accomplished in that the sheet materials 11, 12, 13 are connected—on their respective free ends—to a common pull rod 34. Winding and unwinding is initiated via the pull rod. Alternatively or additionally, the winding shafts 31 of the two roller shades 32, 33 can also be coupled with each other by a coupling means, for example, a gear mechanism, a belt or the like. In this case, a connection of the effect sheet material 13 to the other sheet materials 11, 12 may be omitted. Furthermore, in modification thereof it is also possible to operate the two roller shades 32, 33 independently of each other. The arrangement of the roller shade 32, 33 is such that the space A exists between the effect sheet material 13 and the divergence sheet material 12.

FIG. 5 shows another alternative arrangement 10. In this case, there are no roller shades 32, 33, but pleated shades 35, 36 provided. A first pleated shade 35 is present for the obscuration sheet material 11 and the divergence sheet material 12, while the second pleated shade 36 is present for the effect sheet material 13. In this case, the sheet materials 11, 12 can be pleated and pulled apart in an accordion-like fashion. Each pleated shade 35, 36 may comprise a pull rod 34 that is connected to the free end of the respectively associate sheet material 11, 12, 13. The pull rod 34 may be slidably guided in a guiding arrangement 37. In this case it is also possible to couple the two pull rods 34 with each other or design them as a combined component so that the operation of the pleated shades 35, 36 is coupled.

Figure 6:
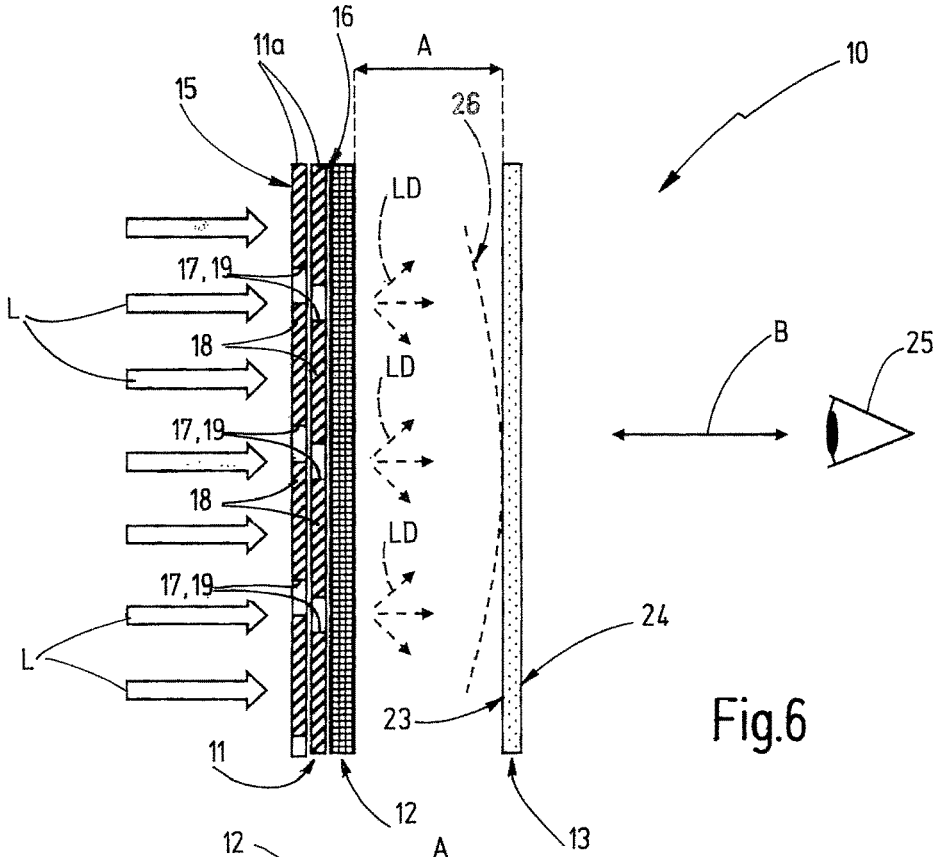
FIGS. 6 and 7 are schematic illustrations of modified exemplary embodiments of the light effect generating arrangements comprising two obscuration sheets that are shiftable relative to each other.
Figure 7:
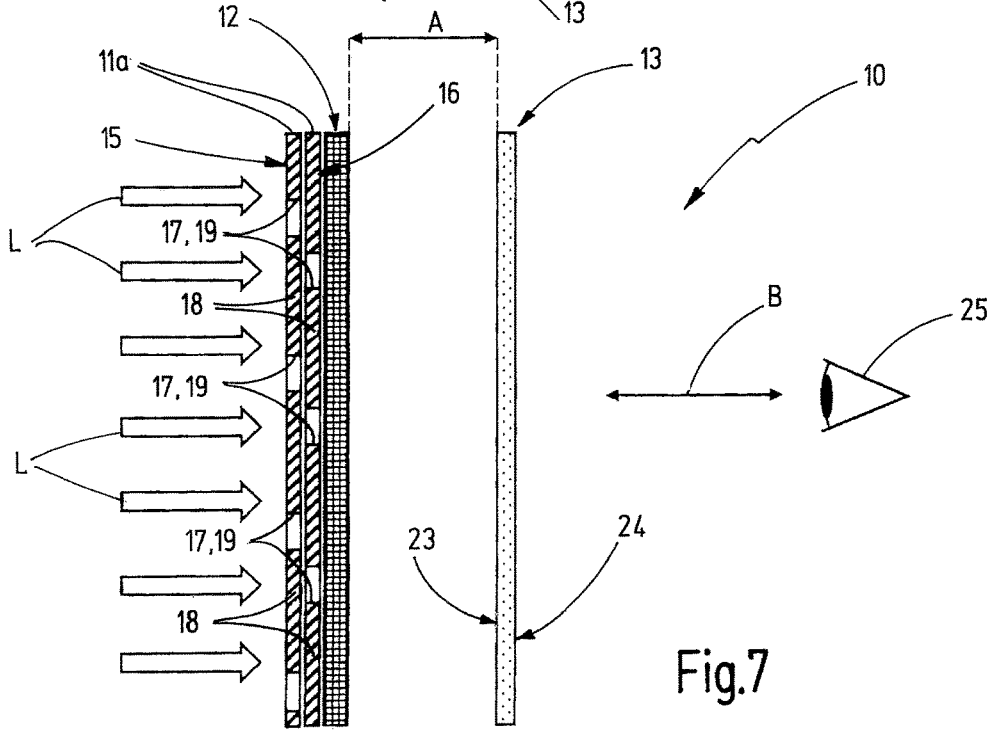

FIGS. 6 and 7 schematically show another exemplary embodiment of the arrangement 10. The obscuration sheet material 11 in this instance comprises two obscuration layers 11*a* that can be shifted relative to each other transversely with respect to the viewing direction B. In so doing, each obscuration layer 11*a* has at least one transmission region 17 and one shielding region 18 that preferably are identically contoured or designed. By shifting the two obscuration layers 11*a*, the transmission regions 17 can be superimposed or shifted relative to each other in such a manner that the transmission region 17 of one obscuration layer 11*a* becomes in register with the shielding region 18 of the respectively other obscuration layer 11*a* (FIG. 7). In this darkening position, no light will pass through the transmission regions 17, and the arrangement 10 can be used for total shadowing or darkening. If the transmission region 17, i.e., for example the apertures 19, of the two obscuration layers 11*a* overlap at least partially, a light effect 26 can be generated (FIG. 6).

Figure 8:
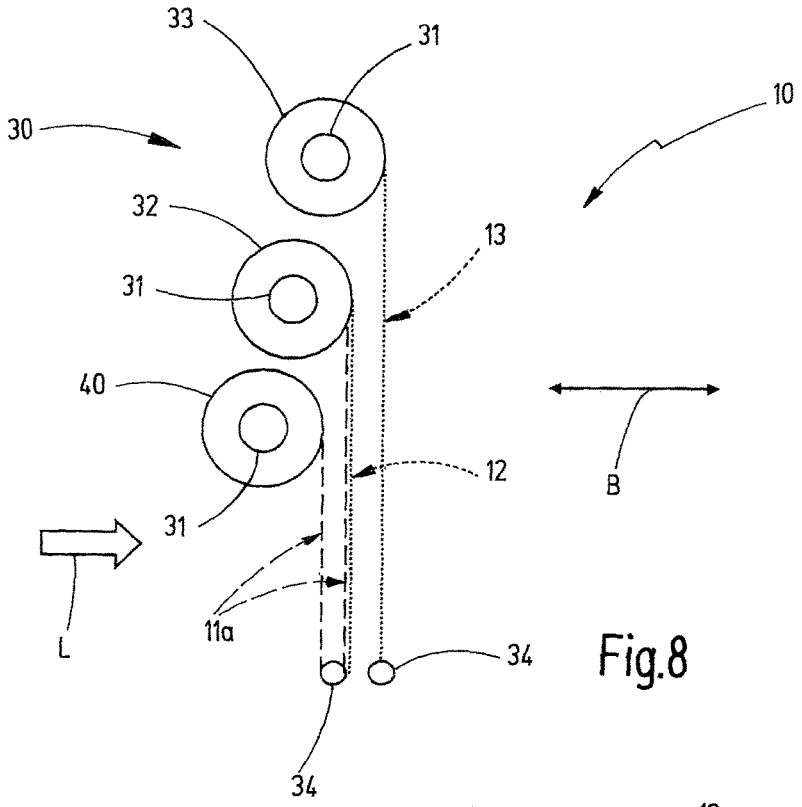
FIG. 8 is a schematic illustration of an exemplary embodiment of a light effect generating arrangement according to FIGS. 6 and 7 configured as a roller shade.

This embodiment can be implemented with a roller shade arrangement 30 (FIG. 8). To do so, a third roller shade 40 may be provided, for example, this being different from the embodiment according to FIG. 4. An obscuration layer 11*a* is wound onto the third roller shade 40, while the respectively other obscuration layer 11*a* is wound on the first roller shade 32. One of the two obscuration layers 11*a* can be connected to the divergence sheet material 12, as illustrated in FIG. 8. As a result of a relative rotation of the two winding shafts 31 of the first roller shade 32 and the third roller shade 40 with respect to each other, the desired relative position between the two obscuration layers 11*a* can be adjusted as explained with reference to FIGS. 6 and 7. The two obscuration layers 11*a* may be associated with a common pull rod 34; however it is also possible to provide separate pull rods 34 for each roller shade 32, 40. Other than that, the roller shade arrangement 30 according to FIG. 8 corresponds to the roller shade arrangement 30 according to FIG. 4, so that reference may be made to the description hereinabove.

It also possible to configure the arrangement 10 with obscuration layers 11*a* that can be shifted relative to each other by using pleated shades. In modification of the exemplary embodiment illustrated by FIG. 5, an additional pleated shade may be provided with the additional obscuration layer 11*a*.

In the foregoing exemplary embodiments, the space A is formed by an air gap between the effect sheet material 13 and the obscuration sheet material 11 or the divergence sheet material 12. In modification thereof, it is possible in all exemplary embodiments to arrange a connecting layer 41 between the effect sheet material 13 and the divergence sheet material 12 or the obscuration sheet material 11. The connecting layer 41 may be made of material that is transparent to the light wave length or the light wave length range originating from the light source L. Preferably, the connecting layer 41 is transmissive to all the light wave lengths of the visible light. However, it is also possible to configure the connecting layer 41 as a color filter in order to adjust a desired lighting color.

Figure 9:
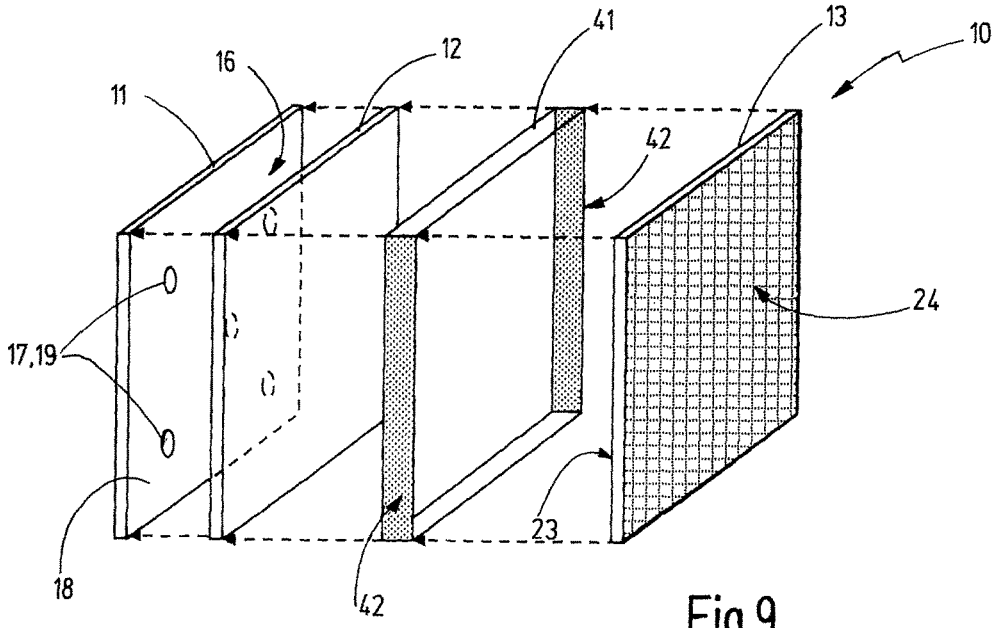
FIG. 9 is an exploded schematic of an exemplary embodiment of the light effect generating arrangement comprising a connecting layer between an effect sheet material and a divergence sheet material.

As shown by FIG. 9, by using a connecting layer 41 it is possible to connect all sheet materials 11, 12, 13 to each other so that the arrangement 10 can be implemented with a single pleated shade or roller shade. The connecting layer 41 can be configured so as to be partially opaque, at least outside the light emitting region of the diverging light rays LD. FIG. 9 shows, schematically, that one or more edge areas, for example the edge areas 42, are configured so as to be opaque or at least almost opaque to visible light. As a result of this, the penetration of interfering light in the regions between the effect sheet material 13 and the divergence sheet material 12 or the obscuration sheet material 11 can be minimized or prevented. It is also possible to use other means, for example, tracks or diaphragms or the like on the roller shade arrangement 30 or on the pleated shade arrangement 35, 36 to prevent the penetration of interfering light in this region. Such means can be arranged, for example, on a guiding arrangement for guiding a pull rod 34 of a roller shade or a pleated shade.

Furthermore, it is possible to use other mechanical devices instead of roller shades or pleated shades for the sheet materials 11, 12, 13. For example, the sheet materials 11, 12, 13 can be held in shiftable and/or pivotable frames. The obscuration sheet material 11 may also be configured as a conventional vane-type roller shutter, wherein the slit openings represent the transmission regions 17. The desired effect sheet material 13 may be installed as a roller shade, pleated shade or the like on the window in order to produce a desired light effect 26. In so doing, the divergence sheet material 12 may consist of several strips that are glued to the slit openings in the roller shutter.

In modification of the described exemplary embodiment it is possible for the divergence sheet material 12 to consist of several parts, wherein each part is associated with a transmission region 17. The parts may be directly connected to each other or they may be separately connected to the obscuration sheet material 11 so that only an indirect connection exists between the parts.

From the foregoing, it can be seen that an arrangement 10 is provided for generating a light effect 26 on a viewing side 24 of an effect sheet material 13. For this purpose, an obscuration sheet material 11 and preferably a divergence sheet material 12 are arranged, spaced apart, on a rear side 23 with respect to the effect sheet material 13, with the rear side facing away from the viewing side 24. The obscuration sheet material 11 has at least one transmission region 17 and at least one shielding region 18. On the light entry side 15, which faces away from the effect sheet material 13, light L impinges on the obscuration sheet material 11 and is at least severely reduced or completely shielded in the at least one shielding region 18. The light L can pass through the at least one transmission region 17. By means of the divergence sheet material 12, divergent light rays LD are produced at the corresponding transmission region 17, which divergent light rays impinge on the rear side 23 of the effect sheet material 13 and generate a light effect 26 for a viewer 25 looking at the viewing side 24.

LIST OF REFERENCE SIGNS

10 Arrangement
11 Obscuration sheet material
11*a* Obscuration layer
11*b* Support layer
12 Divergence sheet material
13 Effect sheet material
15 Light entry side
16 Light exit side
17 Transmission region
18 Shielding region
19 Aperture
23 Rear side
24 Viewing side
25 Viewer
26 Light effect
30 Double roller shade
31 Winding shaft
32 First roller shade
33 Second roller shade
34 Pull rod
35 First pleated shade
36 Second pleated shade
37 Guiding arrangement
40 Third roller shade
41 Connecting layer
42 Edge area
A Space
B Viewing direction
D Distance
L Light
LD Divergent light rays

The invention claimed is:

1. An arrangement (10) for generating a light effect (26) with several sheet materials (11, 12, 13) arranged so as to be at least in partially overlapping relation in viewing direction (B) comprising:

an obscuration sheet material (11) having a light entry side (15) and a light exit side (16), said obscuration sheet material (11) having at least one transmission region (17) and at least one shielding region (18) wherein a light (L) impinging on the light entry side (15) passes through the at least one transmission region (17) and exits on the light exit side (16) and wherein an intensity reduction of the light (L) impinging on the light entry side (15) of the at least one shielding region (18) is greater than an intensity reduction of the light (L) impinging on the at least one transmission region (17);

at least one effect sheet material (13) of a textile material having a rear side (23) facing the light exit side (16) of the obscuration sheet material (11) and a viewing side (24);

said effect sheet material (13) being arranged a distance from the obscuration sheet material (11) wherein the light impinging on the rear side (23) of the effect sheet material (13) is at least partially redirected and exits at least partially on the viewing side (24);

said obscuration sheet material (11) comprising several obscuration layers (11, *a*, 11*b*) that are in planar contact with each other and a support layer (11*b*) on which the at least one of said obscuration layers (11*a*) is arranged; and said support layer (11*b*) extends in the at least one transmission region (17) and forms at least one layer of the divergence sheet material (12).

2. The arrangement (10) of claim 1 in which the effect sheet material (13) is arranged a distance from the obstruction material (11) such that light impinging on the rear side (23) is redirected by at least one of being partially reflected, scattered, refracted, or defracted.

3. The arrangement (10) of claim 1 in which the at least one transmission region (17) is formed by an aperture (19) in the obscuration sheet material (11).

4. The arrangement (10) of claim 1 in which the at least one shielding region (18) totally shields the impinging light.

5. The arrangement (10) of claim 1 including a divergence sheet material (12) disposed in relation to the obscuration sheet material (11) to convert impinging substantially parallel (L) light into divergent light (LD).

6. The arrangement (10) of claim 5 in which the divergence sheet material (11) is arranged between the obscuration sheet material (11) and the effect sheet material (13).

7. The arrangement (10) of claim 5 in which the divergence sheet material (12) and the obscuration sheet material (11) are in contact with each other.

8. The arrangement (10) of claim 5 in which the divergence sheet material (12) is at least one of a foil material and/or a fiber material and/or a textile material.

9. The arrangement (10) of claim 1 in which the support layer (11*b*) extends only in the at least one shielding region (18) and leaves clear the at least one transmission region (17).

10. The arrangement (10) of claim 1 in which at least one of the obscuration sheet material (11) and the effect sheet material (13) can be rolled up and down on one winding shaft (31)(13*a*).

11. The arrangement (10) of claim 1 in which the obscuration sheet material (11) comprises two obscuration layers (11*a*) that can be shifted relative to each other, and each of said obscuration layers having at least one transmission region (17) and at least one shielding region (18).

12. An arrangement (10) for generating a light effect (26) with several sheet materials (11, 12, 13) arranged so as to be at least in partially overlapping relation in viewing direction (B) comprising:

an obscuration sheet material (11) having a light entry side (15) and a light exit side (16), said obscuration sheet material (11) having at least one transmission region (17) and at least one shielding region (18) wherein a light (L) impinging on the light entry side (15) passes through the at least one transmission region (17) and exits on the light exit side (16) and wherein an intensity reduction of the light (L) impinging on the light entry side (15) of the at least one shielding region (18) is greater than an intensity reduction of the light (L) impinging on the at least one transmission region (17);

at least one effect sheet material (13) of a textile material having a rear side (23) facing the light exit side (16) of the obscuration sheet material (11) and a viewing side (24);

said effect sheet material (13) being arranged a distance from the obscuration sheet material (11) wherein the light impinging on the rear side (23) of the effect sheet material (13) is at least partially redirected and exits at least partially on the viewing side (24); and said at least one obscuration sheet material (11) and the effect sheet material (13) are collapsible and expandable in a pleated manner.

13. An arrangement (10) for generating a light effect (26) with several sheet materials (11, 12, 13) arranged so as to be at least in partially overlapping relation in viewing direction (B) comprising:

an obscuration sheet material (11) having a light entry side (15) and a light exit side (16), said obscuration sheet material (11) having at least one transmission region (17) and at least one shielding region (18) wherein a light (L) impinging on the light entry side (15) passes through the at least one transmission region (17) and exits on the light exit side (16) and wherein an intensity reduction of the light (L) impinging on the light entry side (15) of the at least one shielding region (18) is greater than an intensity reduction of the light (L) impinging on the at least one transmission region (17);

at least one effect sheet material (13) of a textile material having a rear side (23) facing the light exit side (16) of the obscuration sheet material (11) and a viewing side (24);

said effect sheet material (13) being arranged a distance from the obscuration sheet material (11) wherein the light impinging on the rear side (23) of the effect sheet material (13) is at least partially redirected and exits at least partially on the viewing side (24); and at least one of the obscuration sheet material (11) and the effect sheet material (13) can be rolled up and down on one winding shaft (31, 13*a*); and at least one of the obscuration sheet material (11) and the effect sheet material (13) comprises a pull rod (34) that is slidably guided in a guiding arrangement (37).

* * * * *